US007268688B2

(12) United States Patent
Juds

(10) Patent No.: US 7,268,688 B2
(45) Date of Patent: Sep. 11, 2007

(54) SHIELDED RFID TRANSCEIVER WITH ILLUMINATED SENSING SURFACE

(75) Inventor: Scott Juds, Seattle, WA (US)

(73) Assignee: IDX, Inc., El Dorado, AR (US)

( * ) Notice: Subject to any disclaimer, the term of this patent is extended or adjusted under 35 U.S.C. 154(b) by 198 days.

(21) Appl. No.: 11/214,922

(22) Filed: Aug. 31, 2005

(65) Prior Publication Data

US 2007/0080810 A1 Apr. 12, 2007

(51) Int. Cl.
*G08B 13/14* (2006.01)

(52) U.S. Cl. ..... 340/572.8; 340/572.7; 340/691.1; 235/439

(58) Field of Classification Search .. 340/572.7–572.8, 340/691.1, 654, 10.1, 693.9; 235/449–450, 235/439

See application file for complete search history.

(56) References Cited

U.S. PATENT DOCUMENTS 4,805,232 A * 2/1989 Ma ..... 455/291
4,847,552 A 7/1989 Howard
5,378,880 A * 1/1995 Eberhardt ..... 235/439
6,069,564 A 5/2000 Hatano et al.
6,116,505 A 9/2000 Withrow
6,229,420 B1 5/2001 Baumi et al.
6,377,176 B1 4/2002 Lee
2005/0162331 A1* 7/2005 Endo et al. ..... 343/788

* cited by examiner

*Primary Examiner*—Jeffery Hofsass
*Assistant Examiner*—Hoi C. Lau
(74) *Attorney, Agent, or Firm*—Diller, Ramik & Wight

(57) ABSTRACT

A transceiver for reading RFID tags has a ferrite core antenna substantially circular in cross-section having a transmitting and receiving face producing substantially no RF energy below a plane of the transmitting and receiving face outside a peripheral surface of the ferrite core. A portion of the transceiver enclosure which passes through a mounting panel opening functions as light pipe for conducting LED indicator light in a substantially radially symmetrical manner to illuminate a sensing surface of the transceiver.

16 Claims, 5 Drawing Sheets

SHIELDED RFID TRANSCEIVER WITH ILLUMINATED SENSING SURFACE

FIELD OF THE INVENTION

This invention pertains to RFID transceivers, and in particular to panel mounted RFID transceivers adapted for a relatively small footprint, antenna tuning immunity to nearby metal, and an illuminated sensing surface for indicating transaction status.

BACKGROUND OF THE INVENTION

RFID tags are rapidly becoming quite important for tracking and identifying goods as well as for identifying customer accounts. Small tags having a transponder chip and antenna offer many advantages over simple bar codes, including unique serialization, non-contact reading through an outer packaging material, and on-chip storage of information for some transponder chip versions. RFID tags have proven themselves to be quite useful in a wide variety of applications, including those such as bin identification, pallet identification, product serialization, access card identification, and account identification.

Just as RFID tag application breath is wide, so also is the environment in which the tags are read. Thus the kind of transceiver antenna that is appropriate for reading tags on a pallet of goods passing through a doorway is different from the kind of transceiver that may be appropriate for reading a patron's account information at a vending machine. The antenna for reading tags on a pallet of goods may be a pair of wire loops two feet wide by four feet tall, one on each side of the pallet when it is in position to be read. Conversely, the antenna for reading a patron's key-fob RFID tag may be single sided, just a few square inches in size at most, and have a correspondingly shorter reading range.

Generally, RFID readers are fairly large and separate from any associated display of the information transmitted or received. Placing display circuitry in close proximity to an RFID transceiver antenna could adversely interact with the antenna by reducing the Q (quality factor) of its resonance through coupling the transmitted energy into the display circuitry resulting in energy loss from the tuned antenna circuit. The Q of an antenna is roughly proportional to both the radiated signal strength and receiver sensitivity, both of which are important for increasing the reading range to an RFID tag. Additionally, a high Q antenna implicitly means that it is narrow band and susceptible to the possibility that metal in the local vicinity may change the tuning of the central resonant frequency of the antenna away from the operating frequency of the RFID system thus degrading the reading range to an RFID tag. The operating frequency of a tuned antenna is inversely proportional to the square root of the antenna's inductance and thus is directly affected by metal objects within the radiation pattern of the antenna. Eddy currents may flow in the metal object as a result of a mutual inductance coupling term between the antenna and the metal object, thus altering the net inductance of the antenna and correspondingly altering the center frequency of the tuned antenna. In order to mount a small RFID reader antenna with an integrated visual display through a metal panel while maintaining its Q and center frequency requires a design that considers and avoids the aforementioned problems.

Mounting an industrial inductive proximity sensor through a metal panel has analogous problems to that of the RFID reader and similarly requires the need for immunity of the sensor to surrounding metal. An inductive proximity sensor having a shielded pot core configuration sensing surface and an indicator LED at the opposite end of its tubular enclosure is disclosed in U.S. Pat. No. 6,229,420 granted May 8, 2001 to Bauml, et al.

A fueling transaction system using RFID tags for customer account identification at the pump is disclosed in U.S. Pat. No. 6,116,505 granted Sep. 12, 2000 to Withrow wherein it is described how communications between the transceiver antenna and transponder tag require the absence of metal objects coming between them and thus when antennas are mounted within the fueling dispenser, glass or plastic dispenser walls are preferable.

An RFID reader having a cylindrical housing with a coil wound ferrite rod core that includes a light emitting diode indicator and a piezo buzzer on the reader's front face is disclosed in U.S. Pat. No. 5,378,880 granted Jan. 3, 1995 to Eberhardt. The disclosure is devoid of any discussion of the effects that the light emitting diode indicator, piezo buzzer, or a metal panel mounting location may have on the Q or center frequency of the antenna.

A multi-directional RFID read/write antenna unit in an industrial proximity sensor housing having a plurality of coils adapted to transmit multi-directional RF signals to an RFID tag and receive RF responses therefrom is disclosed in U.S. Pat. No. 6,069,564 granted May 30, 2000 to Hatano, et al. wherein each of the coils is ferrite shielded from the others and has no means for visual indication integrated with any of the sensing surfaces.

A Metal compensated RFID reader housed so that the influence of metallic objects in its physical surroundings on system performance is minimized by using a pre-compensation metal plate to stabilize the self-resonant frequency of the reader is disclosed in U.S. Pat. No. 6,377,176 granted Apr. 23, 2002 to Lee. There is no means for visual indication integrated with the sensing surface.

A bridge circuit utilizing a pair of back-to-back pot core sensors operating at 10 KHz to provide positive identification of a metal body is disclosed in U.S. Pat. No. 4,847,552 granted Jul. 11, 1989 to Howard. There is no means for visual indication integrated with the sensing surface.

Despite the considerable effort that has been applied heretofore in the design of RFID transceivers none have produced a compact RFID reader that can be mounted through a metal panel and integrate status indication into the sensor face without having the antenna be adversely affected by the presence of the status indicator within the transmitted field or adversely affected by the proximity of the metal in a panel when being mounted therethrough. Many applications for RFID validation are considerably space limited. Manufacturers of equipment that use RFID validation would prefer no restrictions on the materials they use to produce their products just because they wish to install an RFID reader. Finally, many applications for RFID validation do not have other suitable displays available to indicate the status of the sensor or of the information transacted and must rely on a status indicator integrated into the reader.

As can readily be appreciated, there remains a need for further improvement in the features and operation of RFID readers, and in particular RFID readers offering a small footprint that can be mounted through a metal panel and provide status indication integrated with the sensing surface.

SUMMARY OF THE INVENTION

In a first embodiment of the present invention a transceiver for reading RFID tags has an enclosure with a sensing surface suitable for mounting through a panel and for conducting both light and RF energy therethrough. The transceiver has an antenna for transmitting and receiving RF energy that includes a ferrite half pot core inductor having a transmitting and receiving face aligned with and adjacent to the sensing surface. A multi-color LED located on an opposite side of the antenna from the sensing surface indicates at least the functional status of the transceiver. A light pipe conveys the LED light around and/or through the antenna in a substantially radially symmetrical manner to the sensing surface where it is diffused to illuminate the sensing surface of the transceiver. A portion of the enclosure that passes through the panel to the sensing surface functions as part of the light pipe. Light passing through and/or around the ferrite antenna is diffused to provide a more uniform illumination of the sensing surface. A radially symmetrical depression on the inside face of the sensing surface axially aligned with a central hole of a ferrite core preferentially directs light away from an axis of the central hole.

In a second embodiment of the present invention the half pot core ferrite antenna is replaced with an antenna having a disk shaped ferrite with a center post on one face in order to produce a larger sensing range at the expense of having a higher mounting profile on the panel to maintain immunity to metal in the panel.

In a third embodiment of the present invention a multi-color illumination means encircles the ferrite core below the plane of the transmitting and receiving face of the antenna and is composed of a plurality of LEDs disposed in a substantially radially symmetrical pattern to provide substantially radially symmetrical illumination of the sensing surface.

DETAILED DESCRIPTION OF THE INVENTION

Within the description of the invention that follows, the following definitions and meanings will be used. The terms RFID reader and RFID transceiver will have the same meaning. An RFID tag includes an RFID transponder circuit, an antenna, and the physical package enclosing them. RF energy received by the transceiver includes that of a transponder modulating its antenna impedance to cause a time varying portion of the RF energy transmitted by the transceiver to be reflected back to the transceiver. A light pipe is a transparent conduit for conducting light on a path from an entrance aperture to an exit aperture utilizing total internal reflection properties to channel the light along the path, wherein the light pipe is a material of a higher index of refraction surrounded by a material (including air) of a lower index of refraction.

Figure 1A:
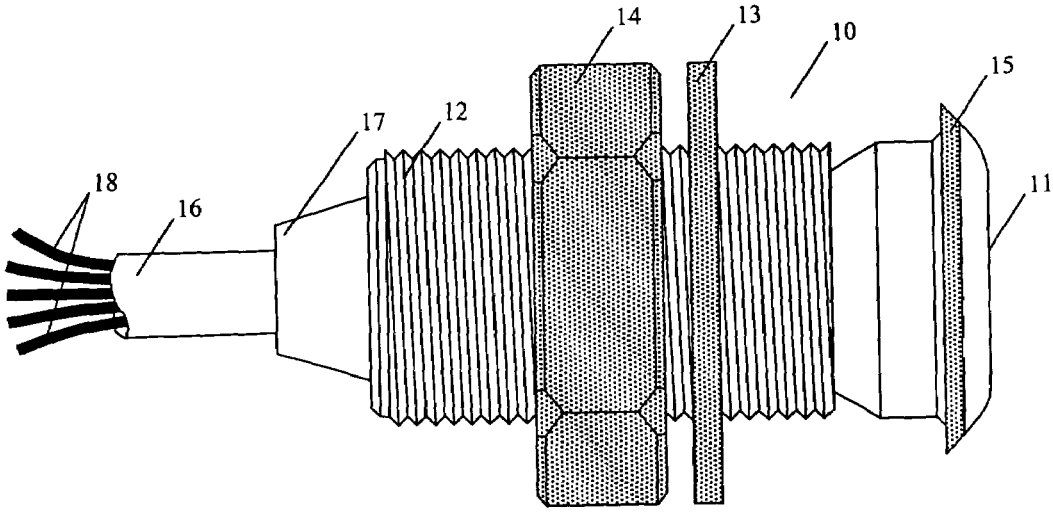
FIG. 1A is a side plan view, and illustrates an RFID transceiver.

An RFID transceiver 10 having sensing surface 11 is shown in FIG. 1A. A threaded tubular body 12 of the RFID transceiver is designed for through-panel mounting and is fastened to a panel 54 (FIG. 3A) between a washer 13 and a sensing surface lip 15 using a threaded nut 14 to hold the assembly tight. A connecting cable 16 passes through an apertured back flange 17 to provide wires 18 for connection of the RFID transceiver 10 to external communication and power supply circuits (not shown).

Figure 1B:
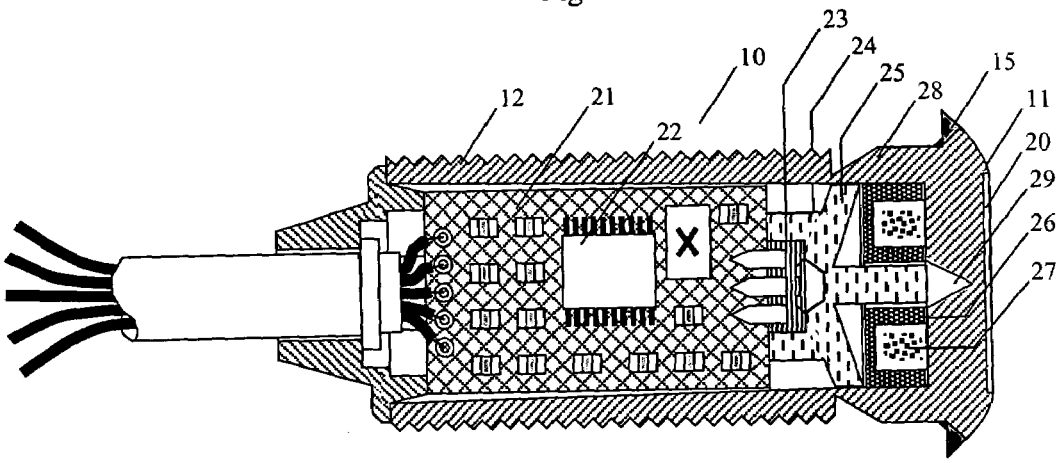
FIG. 1B is an axial cross-sectional view of the RFID transceiver of FIG. 1A, and illustrates interior components of the RFID transceiver of FIG. 1A.

The RFID transceiver 10 (FIG. 1B) includes a label recess 20 on a sensing surface 11 for attachment thereto of a graphic label. A transceiver circuit board 21 located inside the threaded tubular body 12 has a transceiver chip 22 and other associated electronic components mounted thereon. RFID transceiver chips are manufactured by WJ Communications, Atmel, Texas Instruments, and others. The preferred embodiment of this invention utilizes the RI-R6C-001A chip from Texas Instruments. This multi-protocol transceiver chip enables 13.56 MHz RFID interrogator designs for portable and stationary readers. The corresponding Reference Guide provided by Texas Instruments for this chip provides detailed circuit design information for use of the chip in customized products. Of the many RFID frequencies for which a design could be made, this one is preferred because of the convenient pre-packaged RFID tags available from Texas Instruments and the market momentum garnered for this particular product family by having also been selected by AMEX and MasterCard for incorporation into credit cards.

A multi-color LED 23 emits light into a prismatic aperture 24 of a light pipe 25 for conveyance around and through a ferrite core antenna 26 to the sensing surface 11 where it may be viewed by a patron interacting with the RFID transceiver. One such suitable LED 23 is the GM5WA06250Z super-luminosity RGB LED from Sharp having a red, green, and blue LED die all in the same reflective depression of a six-pin packaged device. As is commonly understood, the mixing of various proportions of light from the three LED die will produce a plurality of perceptible colors. For example, the equal mixture of red and green will produce yellow, the equal mixture of all three produces white, and so forth. By illuminating the sensing surface 11 of the RFID transceiver 10 with different colors, the patron can determine the current status of the RFID transceiver 10, of the data being transferred, or of the function being requested. For example, the sensing surface 11 could be illuminated blue to indicate normal idle conditions, green to indicate acceptance of the account identity, red to indicate rejection of the account identity, yellow to indicate the inability to perform the function, purple to indicate malfunction of the transceiver or its data connection, and so forth. In this manner, sufficient operational status information is conveyed to a patron without the need for a separate display.

Figure 1C:
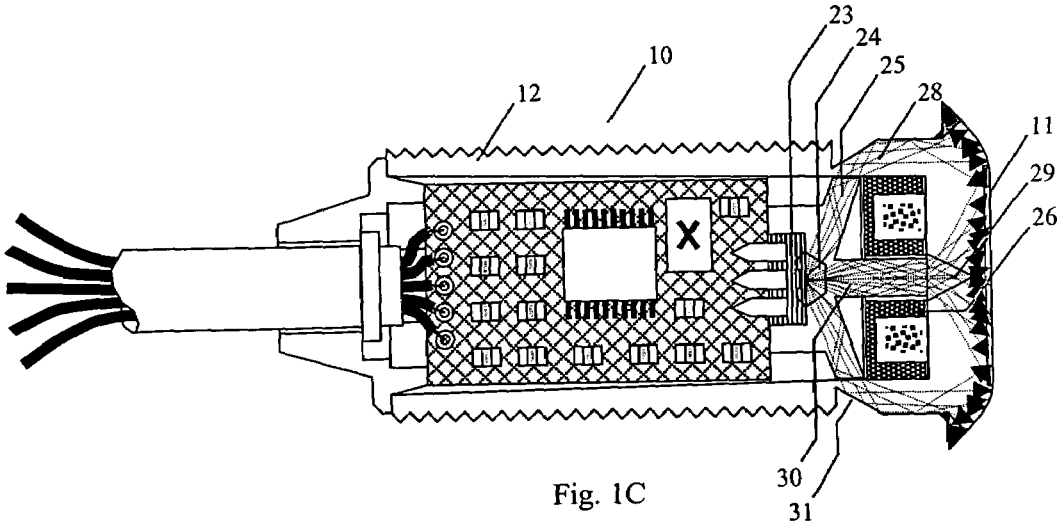
FIG. 1C is is an axial cross-sectional view of the RFID transceiver of FIG. 1A, and illustrates a light pipe functionality for an RFID transceiver.
Figure 2:
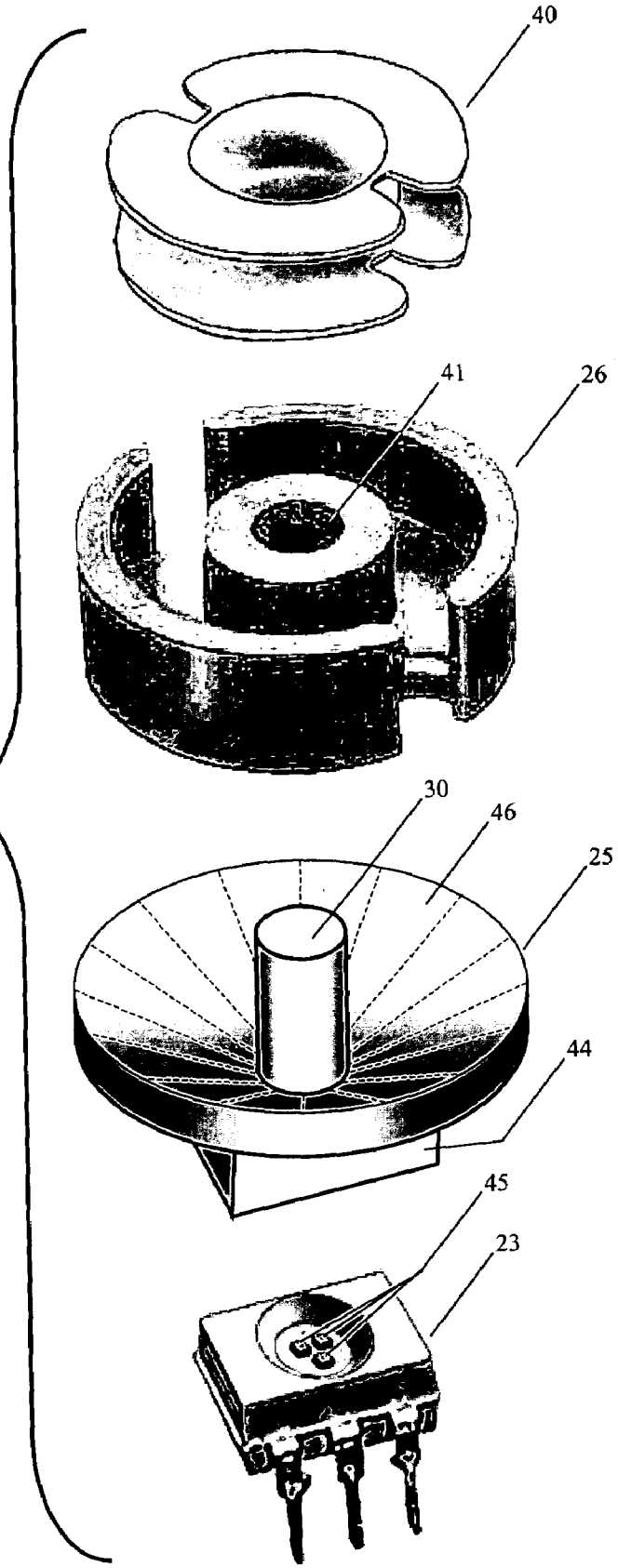
FIG. 2 is an isometric exploded view, and illustrates the winding bobbin, ferrite pot core, radially symmetrical light pipe, and multi-color LED for the RFID transceiver of FIG. 1A.

The RFID transceiver 10 in FIG. 1C shows the path of numerous light rays (unnumbered headed arrows) emanating from LED 23 into the prismatic aperture 24. The prismatic aperture 24 serves to preferentially refract the emanated light rays toward either a lateral portion 46 (FIG. 2) of the right pipe 25 or the central portion 30 of the light pipe 25 such that the angle of incidence of the light rays on the respective surfaces of those light pipe portions are predominantly less than about 49° degrees. According to Snell's Law 49° is the maximum angle of incidence for which total internal reflection will occur for a light pipe material having an index of refraction of 1.55, such as poly-carbonate, when it is surrounded by air having an index of refraction of 1.0. Ideally, the faces of the prismatic aperture 24 are substantially perpendicular to the path of a light ray traveling from the emitting point of light from LED 23 down through the center of the respective light pipe portion. The resulting preferred geometrical shape of the circularly symmetrical prismatic aperture 24 is that of a frustum.

Light rays traveling through the central portion 30 of the light pipe 25 exit the light pipe after passing through a central hole of pot core antenna 26 and enter a conical depression 29 on the inside face of the sensing surface 11 of the enclosure 10. The conical depression 29 acts as a prismatic diffuser or spreader and is axially aligned with a central hole of the ferrite pot core antenna 26 for preferentially directing light away from the axis of the central hole toward areas between the ferrite pot core antenna 26 and the sensing surface 11 in order to more uniformly illuminate the entirety of the sensing surface 11.

Light rays traveling through a lateral portion 46 of light pipe 25 exit the light pipe 25 where it meets with the threaded tubular body 12 which is molded with a transparent material such as polycarbonate. The portion 28 of the threaded tubular body 12 between the lateral portion 46 of light pipe 25 and sensing surface 11 is designed to perform the function of a light pipe. The light rays exiting the lateral portion of light pipe 25 enter the threaded tubular body 12 where the light rays reflect off an annular facet 31 due to total internal reflection and travel through light pipe portion 28 toward the sensing surface 11 of the RFID transceiver 10. The sensing surface 11 of the RFID transceiver 10 is matte textured to provide scattering of the light rays reaching the sensing surface 11. Matte texturing fills a surface with randomly oriented prismatic micro-facets, each bending light in a correspondingly random direction and resulting in a uniform surface glow effect when back lit and viewed from a macro perspective.

Through strategic utilization of light pipe 25, the facet 31, the light pipe portion 28, the prismatic apertures 24 and 29, and the light diffusing textured sensing surface 11, the objective of substantially uniformly illuminating the sensing surface 11 of the RFID transceiver 10 is accomplished without placing any circuitry or electronic components within the RF field generated by the ferrite pot core antenna 26 that may adversely affect its Q or central resonant frequency.

The ferrite pot core antenna 26 (FIG. 2) of the preferred embodiment is 14mm in diameter with a central hole 41 and is made of a ferrite that continues to have low material losses up through the 13.56 MHz operating frequency. One example is the Epcos P/N B65541-D-R1 pot core with type K1 ferrite. Typically pot cores are used in pairs and have bobbins made accordingly. However, a half height bobbin 40 (FIG. 2) for single sided operation is available from Cosmo as P/N 1221-0. The light pipe 25 includes a central post portion 30 (FIGS. 1C and 2) for conveying light through the central hole 41 of pot core antenna 26, a lateral portion 46 in a conical dish shape for conveying light out to the threaded tubular body 12, and an alignment box portion 44 for slipping over LED 23 to align it with the central post 30 of the light pipe 25. LED 23 has a centrally located reflective depression in which 3 LED die 45 (FIG. 2) are mounted and between them are able to provide multi-color light.

Figure 3A:
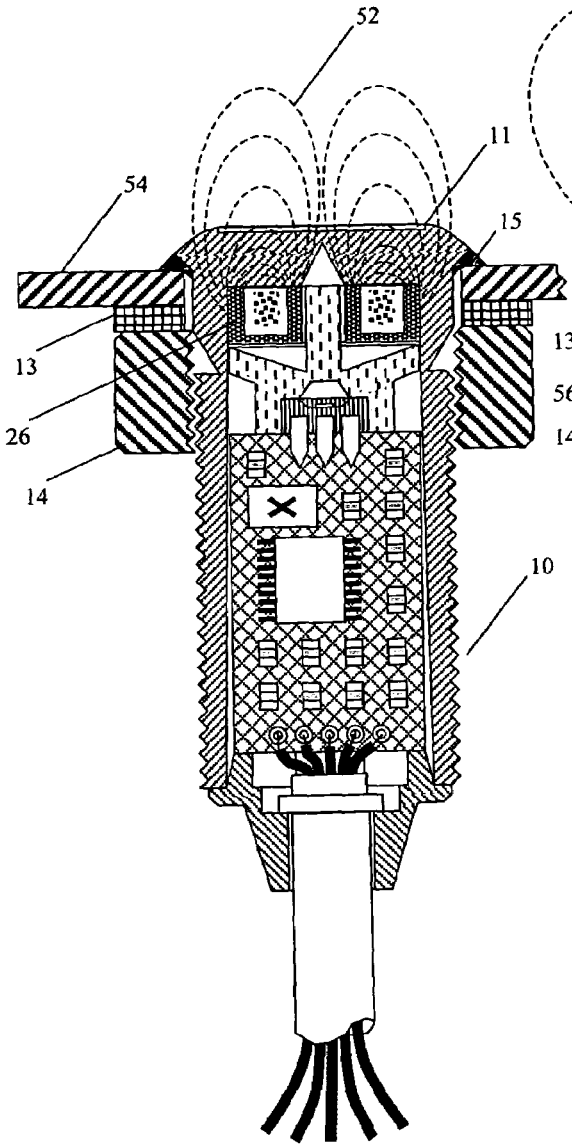
FIG. 3A is an axial cross-sectional view, and illustrates the RF sensing field for the RFID transceiver of FIGS. 1A-1C mounted in a panel.
Figure 3B:
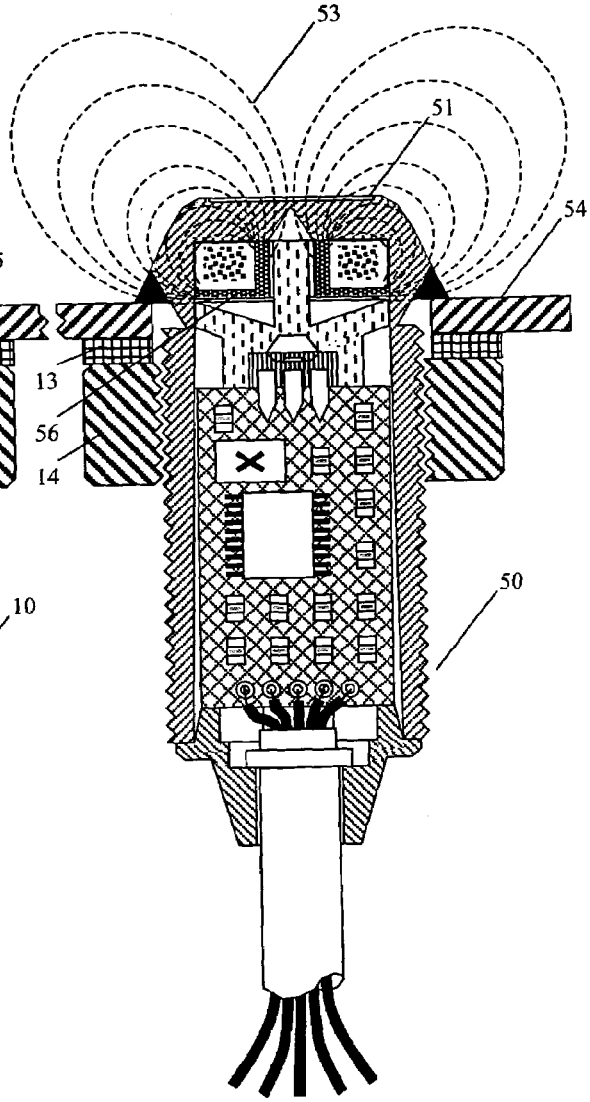
FIG. 3B is an axial cross-sectional view, and illustrates the RF sensing field for the RFID transceiver of FIGS. 1A-1C mounted in a panel.
Figure 4A:
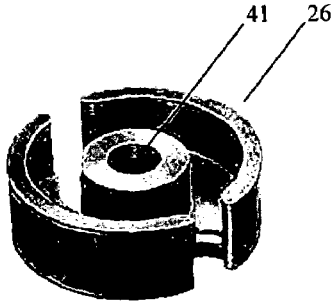
FIG. 4A is an isometric view, and illustrates a ferrite core for an antenna.
Figure 4B:
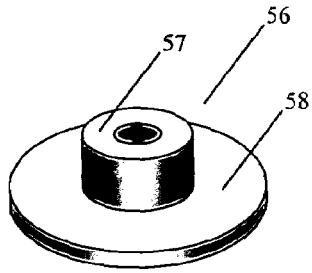
FIG. 4B is an isometric view, and illustrates another ferrite core for an antenna.

An RFID transceiver 10 of FIG. 3A is mounted through the panel 54 with its sensing surface 11 emitting an RF field 52 from ferrite pot core antenna 26 (shown separately in FIG. 4A). An RFID transceiver 50 of FIG. 3B, substantially similar to the RFID transceiver 10, is mounted through the panel 54 with its sensing surface 51 emitting RF field 53 from ferrite antenna 56 having a disk 58 with post 57 geometry a shown in FIG. 4B. The RF field 53 of RFID transceiver 50 extends measurably upwardly and outwardly in comparison to the RF field 52 of RFID transceiver 10 because of the differences in their ferrite core antenna geometries. An advantage of the RFID transceiver 10 is that it is lower profile, and an advantage of the RFID transceiver 50 is that it has greater sensing range, either of which could be preferable for a particular application. In both cases, the RF fields 52 and 53 do not interact with the mounting panel 54 and the sensing surfaces 11 and 51 are well illuminated. The ferrite core 56 can be separately produced in a mold, or alternatively can be a machined version of pot core 26. Machining ferrites is a common practice in the industry to achieve precision gaps and other features. The geometry of the ferrite core 56 is also commonly used in the industrial proximity sensor market for extended range sensing.

Figure 5:
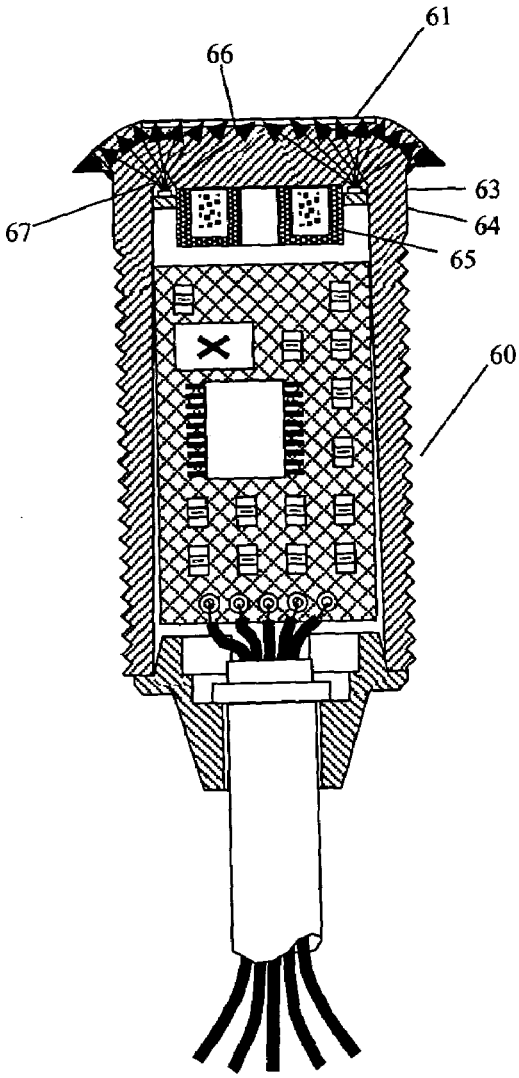
FIG. 5 is an axial cross-sectional view, and illustrates an illumination means encircling a ferrite core antenna of an RFID transceiver.
Figure 6:
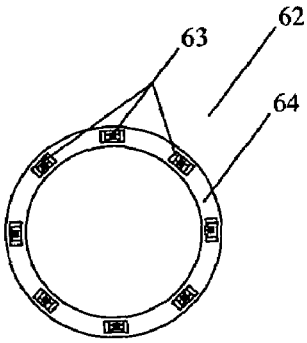
FIG. 6 is a top plan view of the RFID transceiver of FIG. 5, and illustrates an illumination means for encircling the ferrite core antenna of an RFID transceiver.

An RFID transceiver 60 of FIG. 5 utilizes a plurality of LEDs 63 (FIG. 6) disposed in a substantially radially symmetrical pattern around a ferrite core antenna 65 on a circuit board 64 to provide a substantially radially symmetrical illumination of a sensing surface 61. The light rays (66 being one of them) emanating from LEDs 63 are concentrically aligned beneath an annular depression 67 on an inside face (unnumbered) of the sensing surface 61 for preferentially directing light radially inward and radially outward from the annular depression 67 in order to more uniformly disperse light over the entirety of the sensing surface 61. The annular depression 67 could take a variety of shapes, but is preferably "v"-shaped in cross-section as depicted in FIG. 5. An illuminator assembly 62 shown in FIG. 6 is defined by the plurality of LEDs 63 and the circuit board 64.

Figure 7:
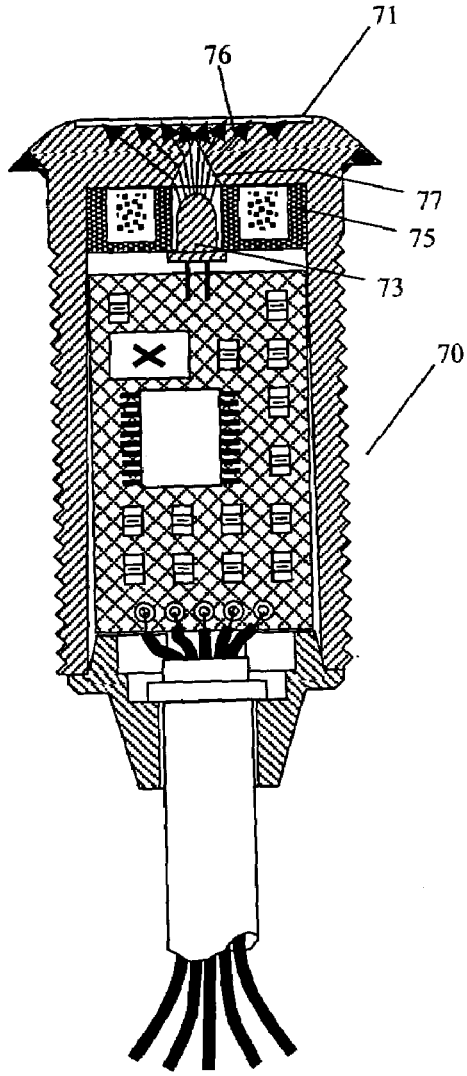
FIG. 7 is an axial cross-sectional view, and illustrates light rays of an illumination means passing through a central hole in the ferrite core antenna of an RFID transceiver.

An RFID transceiver 70 of FIG. 7 utilizes a single central LED 73 located in a central hole (unnumbered) of a ferrite core antenna 75. The light rays (76 being one of them) emanating from LED 73 pass through a radially symmetrical depression 77 on a inside face of a sensing surface 71 axially aligned with the central hole of the ferrite core antenna 75 for preferentially directing light away from the axis of the central hole in order to more uniformly disperse light over the sensing surface 71. The radially symmetrical depression 77 could take a variety of shapes, but is preferably "v"-shaped in cross-section, as depicted in FIG. 7.

Figure 8:
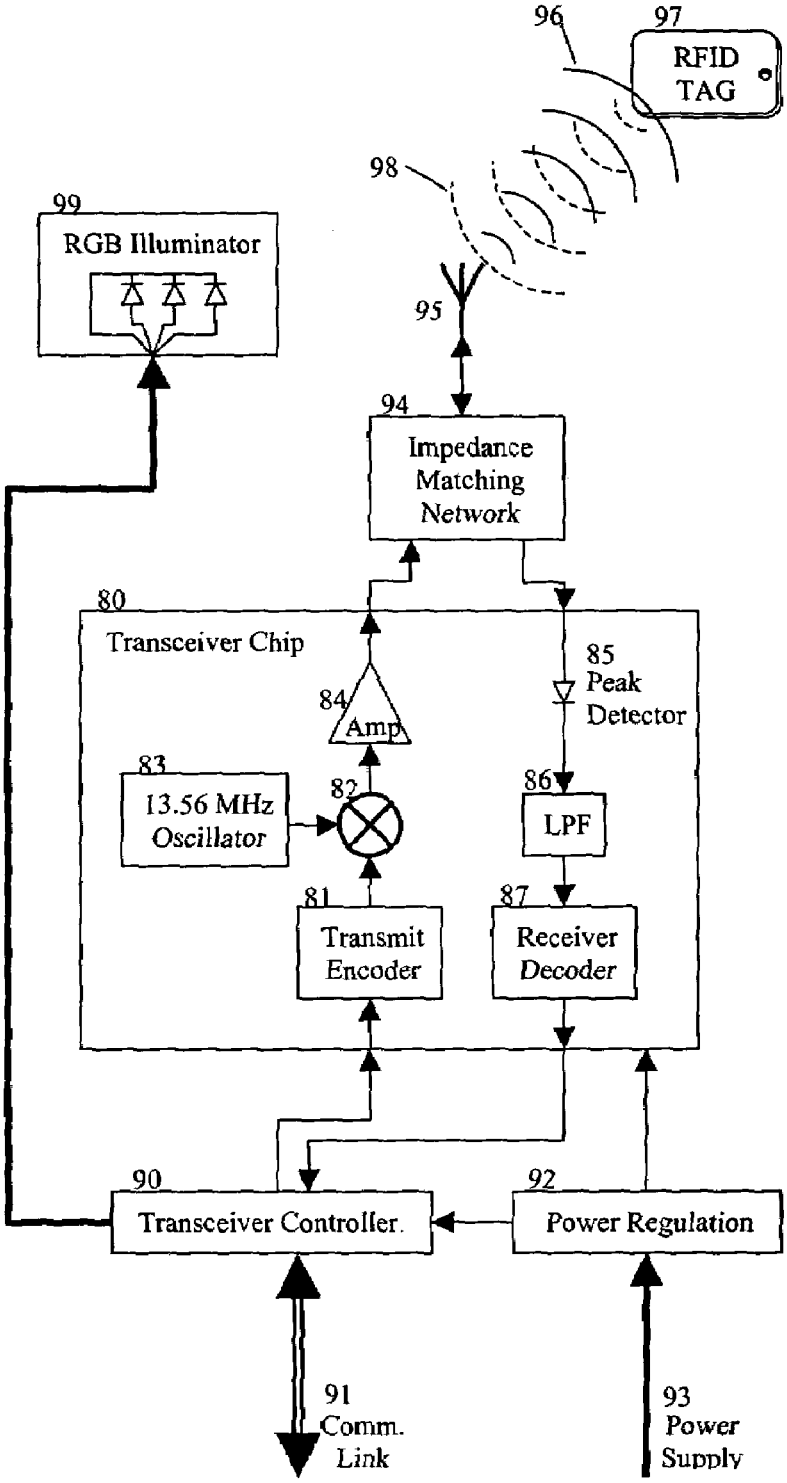
FIG. 8 is a block diagram of an RFID system including an RFID transceiver, and illustrates components thereof and cooperative interaction therebetween.

An RFID system 100 of FIG. 8 includes a transceiver controller 90 which receives commands over a communication link 91 and translates the commands into requisite messages to send to a transmit encoder 81 for modulation by a mixer 82 with 13.56 MHz from an oscillator 83 in the mixer 82. The output of the mixer 82 passes through an output amplifier 84, through an impedance matching network 94 to an antenna 95. In order to most efficiently launch a transmission from the antenna 95, the impedance of the antenna 95 must be matched to the impedance of the output amplifier 84 on a transceiver chip 80. This is accomplished by passive a RLC network 94 as specified for the preferred RI-R6C-001A transceiver chip 80 in the corresponding Reference Guide provided by Texas Instruments. An RF field 96 is transmitted to RFID tag 97 which has an antenna and a transponder chip embedded within the tag 97. Most RFID transponders are powered by energy extracted from the transmitted RF field 96, and respond not by transmitting energy of their own per say, but rather by modulating the impedance of their own antenna to cause energy to be alternately absorbed or reflected by their antenna back to the transceiver antenna 95. The transceiver detects the coherent RF field reflection 98 as a minute change in signal voltage at its own antenna 95. The received signal is processed through the impedance matching network 94, a peak detector 85, and a low pass filter 86. The output from the low pass filter 86 is decoded into information by a receiver decoder 87 and is delivered back to the transceiver controller 90 for evaluation and possible transmission on communication link 91. External power supply 93 is regulated by ordinary voltage regulators in a power regulator block 92 to provided power to the transceiver controller 90 and transceiver chip 80. RGB illumination LEDs 99 of any of the RFID transceivers 01, 50, 60 and 70 heretofore described are controlled by the transceiver controller 90 to produce a plurality of colors as so directed to represent the status of the transceiver, the information transacted, or a request made.

The transceiver controller 90 may be virtually any ordinary microcontroller having a first serial communication port to support the communication link 91 and a second serial communication port to support communication with the transceiver chip 80. For example, the MC68HC705C8A microcontroller by Freescale (previously Motorola) provides two such serial communication ports as well as parallel ports capable of driving the three die of LED 23, for example, of the RFID transceiver 10. The firmware of the transceiver controller 90 is adapted for formatting communication messages to and from the transceiver chip 80 to simplify the communication protocol over the communication link 91. The communication protocol of the communication link 91 could be as simple as reporting the ID of any valid RFID tag 97 that is correctly read at least twice in a row and receiving a command to change the color of the RGB illuminator 99 to a particular color for a specified period of time. The details for creating such a simple protocol are well understood by those skilled in the art. The protocol for communication between the transceiver controller 90 and the transceiver chip 80 are fully detailed in the RI-R6C-001A transceiver chip Reference Guide provided by Texas Instruments and need only be coded for implementation in the transceiver controller 90. Components for the transceiver controller 90 could be mounted to the back side of the transceiver circuit board 21 of FIG. 1B or on a secondary circuit board (not shown) located behind circuit board 21, but electrically connected to it as required.

It is to be understood that the above-described embodiments of the invention are illustrative only, and many variations and modifications will become apparent to one skilled in the art without departing from the spirit and scope of the present invention.

I claim:

1. A transceiver for reading RFID tags comprising an enclosure for mounting through an opening of a panel, the enclosure including a sensing surface for conducting both light and RF energy therethrough, an antenna for transmitting and receiving RF energy including a ferrite core inductor substantially circular in cross-section having a transmitting and receiving face aligned with and adjacent to the sensing surface, a multi-color LED means located on an opposite side of the antenna from the sensing surface for indicating at least the functional status of the transceiver, a light pipe for conveying LED light around the antenna in substantially a radially symmetrical relationship to the sensing surface, and a light diffusing means for scattering the LED light passing through the sensing surface.

2. The transceiver for reading RFID tags according to claim 1 wherein a portion of the enclosure that passes through the panel to the sensing surface functions as at least part of the light pipe for conducting light produced by the LED means around the antenna to the sensing surface.

3. The transceiver for reading RFID tags according to claim 1 wherein the ferrite core is a half pot core.

4. The transceiver for reading RFID tags according to claim 1 wherein the ferrite core is substantially disk shaped having a center post.

5. A transceiver for reading RFID tags comprising an enclosure for mounting through an opening of a panel, the enclosure including a sensing surface for conducting both light and RF energy therethrough, an antenna for transmitting and receiving RF energy including a ferrite core inductor substantially circular in cross-section with a central hole and having a transmitting and receiving face aligned with and adjacent to the sensing surface, a multi-color LED means for enabling the transmission of LED light through the central hole of the ferrite core inductor to the sensing surface for indicating at least the functional status of the transceiver, and a light diffusing means for scattering the LED light passing through the sensing surface.

6. The transceiver for reading RFID tags according to claim 5 wherein the LED means is located within the central hole.

7. The transceiver for reading RFID tags according to claim 5 wherein the LED means is located on an opposite side of the antenna from the sensing surface and a light pipe conveys the LED light through the central hole to the sensing surface.

8. The transceiver for reading RFID tags according to claim 5 wherein the light diffusing means includes a radially symmetrical depression on an inside face of the sensing surface axially aligned with the central hole of the ferrite core for preferentially directing light away from the axis of the central hole.

9. A transceiver for reading RFID tags comprising an enclosure for mounting through an opening of a panel, the enclosure including a sensing surface for conducting both light and RF energy therethrough, an antenna for transmitting and receiving RF energy including a ferrite core inductor substantially circular in cross-section with a central hole and having a transmitting and receiving face aligned with and adjacent to the sensing surface, a multi-color LED means located on an opposite side of the antenna from the sensing surface for indicating at least the functional status of the transceiver, a light pipe for conveying a portion of the LED light through the antenna and a portion of the LED light around the antenna in a substantially radially symmetrical manner to the sensing surface, and a light diffusing means for scattering the LED light passing through the sensing surface.

10. The transceiver for reading RFID tags according to claim 9 wherein a portion of the enclosure that passes through the panel to the sensing surface functions as at least part of the light pipe for conducting light produced by the LED means around the antenna to the sensing surface.

11. A transceiver for reading RFID tags comprising an enclosure for mounting through an opening of a panel, the enclosure including a sensing surface for conducting both light and RF energy therethrough, an antenna for transmitting and receiving RF energy including a ferrite core inductor substantially circular in cross-section having a transmitting and receiving face aligned with and adjacent to the sensing surface, the antenna producing substantially no RF energy below a plane of the transmitting and receiving face outside a peripheral surface of the ferrite core, a multi-color illumination means encircling the ferrite core below the plane of the transmitting and receiving face of the antenna for indicating at least the functional status of the transceiver, and a light diffusing means for scattering light produced by the multi-color illumination means passing through the sensing surface.

12. The transceiver for reading RFID tags according to claim 11 wherein the multi-color illumination means includes a plurality of LEDs disposed in a substantially radially symmetrical pattern to provide substantially radially symmetrical illumination of the sensing surface.

13. The transceiver for reading RFID tags according to claim 12 wherein the light diffusing means includes an annular depression on an inside face of the sensing surface concentrically aligned over the plurality of LEDs for preferentially directing light radially inward and radially outward from the annular depression.

14. A method of reading an RFID tag comprising the steps of mounting a sensing surface of an RFID transceiver through a panel, providing an RFID transceiver antenna, the antenna including a ferrite core inductor substantially circular in cross-section having a transmitting and receiving face aligned with and adjacent to the sensing surface wherein substantially no RF energy radiates from the antenna below a plane of the transmitting and receiving face outside a peripheral surface of the ferrite core, modulating RF energy with information for transmission through the sensing surface to an RFID tag, demodulating RF energy into information received in reply from the RFID tag, evaluating the received information and the state of the RFID transceiver to determine which of a plurality of colors of light an LED indicator will produce, conveying indicator light to the sensing surface in a substantially radially symmetrical manner, and scattering the indicator light passing through the sensing surface.

15. The method of reading an RFID tag according to claim 14 wherein the step of conveying indicator light to the sensing surface further includes the step of conveying indicator light around the antenna to the sensing surface through a portion of an enclosure acting as a light pipe.

16. The method of reading an RFID tag according to claim 14 further including the step of preferentially directing indicator light away from the axis of the central hole as it passes through a radially symmetrical depression on the inside face of the sensing surface axially aligned with the central hole.

* * * * *